US006792840B2

(12) United States Patent
Myers et al.

(10) Patent No.: US 6,792,840 B2
(45) Date of Patent: Sep. 21, 2004

(54) FOLDING PLUNGER ASSEMBLY FOR BLANKING SYSTEM

(75) Inventors: Rick D. Myers, Conyers, GA (US); David J. Coursey, Conyers, GA (US)

(73) Assignee: Atlas Die LLC, Elkhart, IN (US)

( * ) Notice: Subject to any disclaimer, the term of this patent is extended or adjusted under 35 U.S.C. 154(b) by 0 days.

(21) Appl. No.: 10/132,649

(22) Filed: Apr. 25, 2002

(65) Prior Publication Data

US 2004/0094007 A1 May 20, 2004

Related U.S. Application Data

(60) Provisional application No. 60/355,252, filed on Feb. 8, 2002.

(51) Int. Cl.[7] ..... B26D 7/18

(52) U.S. Cl. ..... 83/128; 83/282; 83/458

(58) Field of Search ..... 83/128, 282, 452, 83/458, 459, 462, 466, 123; 254/11–17, DIG. 1, DIG. 4, 8 B, 10 R, 10 B, 10 C, 122; 269/310, 901

(56) References Cited

U.S. PATENT DOCUMENTS

| | | | | | |
|---|---|---|---|---|---|
| 1,080,375 | A | * | 12/1913 | Senderling | 254/122 |
| 1,576,721 | A | * | 3/1926 | Conrad | 254/122 |
| 1,859,830 | A | * | 5/1932 | Kummel | 254/122 |
| 2,097,032 | A | * | 10/1937 | Marlowe | 254/122 X |
| 2,921,772 | A | * | 1/1960 | Boyd | 254/13 X |
| 3,850,064 | A | * | 11/1974 | Dwyer | 83/128 X |
| 3,992,966 | A | * | 11/1976 | D'Agostino | 83/282 X |
| 4,192,208 | A | * | 3/1980 | Muinker et al. | 83/282 X |
| 4,444,075 | A | * | 4/1984 | Mulry | 83/128 |
| 5,049,122 | A | | 9/1991 | Marschke | 493/373 |
| 5,100,040 | A | | 3/1992 | Kunreuther et al. | 225/105 |
| 5,176,061 | A | * | 1/1993 | Mano | 83/128 X |
| 5,179,882 | A | | 1/1993 | Takeuchi et al. | 83/125 |
| 5,222,717 | A | | 6/1993 | Traficant | 254/122 |
| 5,529,565 | A | | 6/1996 | Oetlinger | 493/468 |
| 5,599,269 | A | | 2/1997 | Oetlinger | 493/468 |
| 5,605,527 | A | | 2/1997 | Gillieron | 493/342 |
| 5,735,442 | A | | 4/1998 | Emrich | 225/1 |
| 5,766,123 | A | | 6/1998 | Oetlinger | 493/468 |
| 5,810,233 | A | | 9/1998 | Varidel | 225/97 |
| 5,971,378 | A | | 10/1999 | Sweeney | 269/6 |
| 6,045,122 | A | | 4/2000 | Torres | 254/88 |
| 6,308,602 | B1 | * | 10/2001 | Gerber | 83/282 X |
| 6,334,605 | B1 | * | 1/2002 | Kikuchi | 254/DIG. 1 X |
| 2003/0107167 | A1 | | 6/2003 | Oetlinger | |
| 2003/0116036 | A1 | | 6/2003 | Oetlinger | |
| 2003/0119643 | A1 | | 6/2003 | Oetlinger | |

OTHER PUBLICATIONS

Copy of U.S. patent appln. No. 10/054,127 to Myers et al., filed Oct. 22, 2001.

Copy of U.S. patent appln. No. 09/845,677 to Myers et al., filed Apr. 30, 2001.

* cited by examiner

*Primary Examiner*—Charles Goodman

(74) *Attorney, Agent, or Firm*—Kilyk & Bowersox, P.L.L.C.

(57) ABSTRACT

A plunger assembly is provided for gripping blanking material or blanking scrap during a blanking operation. The plunger assembly includes a base member; a pivoting gripper or plunger member, and a pair of connecting legs connecting the pivoting gripper member to the base member. The assembly is adapted to pivot with respect to at least one of the base member and the pivoting gripper member through a predetermined pivot angle range for changing a distance between the base member and the pivoting gripper member. By pivoting, a folding and unfolding of the plunger assembly can be effected during a blanking operation.

17 Claims, 5 Drawing Sheets

FOLDING PLUNGER ASSEMBLY FOR BLANKING SYSTEM

CROSS REFERENCE TO RELATED APPLICATION

The present application claims a priority benefit under 35 U.S.C. § 119(e) from U.S. patent application Ser. No. 60/355,252, filed Feb. 8, 2002, which is incorporated herein in its entirety by reference.

BACKGROUND OF THE INVENTION

1. Technical Field of the Invention

This invention generally relates to presser assemblies for a blanking operation, and, more particularly, to presser assemblies for supporting blanking scrap such as carton or paper blanking scrap during a blanking operation.

2. Description of Related Art

In the manufacture of cartons and paper products, small sheets of material are typically cut out of larger sheets. These smaller sheets are known as blanks. Blanks can be formed into various shapes, such as, by way of example, boxes. Blanks are formed during a process known as a blanking operation. In a blanking operation, the blanks are cut, but not necessarily removed, from a large sheet of carton, paper, paperboard, or cardboard material. After the blanks are cut, the sheet is positioned over a frame for support. The frame typically includes large openings that correspond in size and in position to the blanks previously cut. Below the frame is a mechanism for stacking the blanks.

To hold the scrap material during a die cutting, scoring, creasing, or embossing operation, what is known in the art as a presser assembly is used. The presser assembly can include a member that is biased away from a tool support plate, such as a die rule retaining board. As the tool is lowered, the presser member frictionally engages the sheet of material such that the blanking sheet is secured between the presser member and a counterplate or frame. The tool continues to approach the blanking sheet while the blanking sheet is stabilized by the presser member.

Presser assemblies of the prior art, by virtue of their configuration and size, generally do not offer the possibility of holding relatively small portions of blanking scrap of a blanking sheet. Hence, where relatively small portions of blanking scrap are all that remains of the blanking sheet, there disadvantageously exists the possibility when using presser assemblies of the prior art that such smaller portions of the blanking sheet may not be stabilized or engaged by conventionally sized and designed presser assemblies. Furthermore, because presser assemblies need to be positioned clear of cutting, scoring, creasing, and embossing tools, there is often insufficient space in which to position or mount a conventional presser assembly.

The prior art fails to provide a plunger assembly that offers a simple configuration which is less costly to manufacture and easier to assemble, and which is further easily and efficiently mountable to a support plate, such as a backer board, of a blanking device. In addition, the prior art fails to provide a plunger assembly that offers a configuration and size that can be used to effectively advance, grip, and frictionally engage relatively smaller portions of a blanking sheet and/or blanking scrap during a blanking operation.

SUMMARY OF THE INVENTION

It is a purpose of the present invention to solve the above-mentioned problems.

To achieve the above purpose, the present invention provides a plunger assembly for gripping and/or frictionally engaging cut or uncut blanks and/or blanking scrap during a blanking operation. According to an embodiment of the present invention, a plunger assembly is provided that includes: a base member, a pivoting gripper member, and pivoting, connecting legs connecting the base member to the gripping member. The legs include a biasing device to maintain the base member and the pivoting gripper member spaced from each other.

Further details of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only. The drawings are not intended to limit the present invention. In the drawings.

DETAILED DESCRIPTION OF THE PREFERRED EMBODIMENTS

Figure 1A:
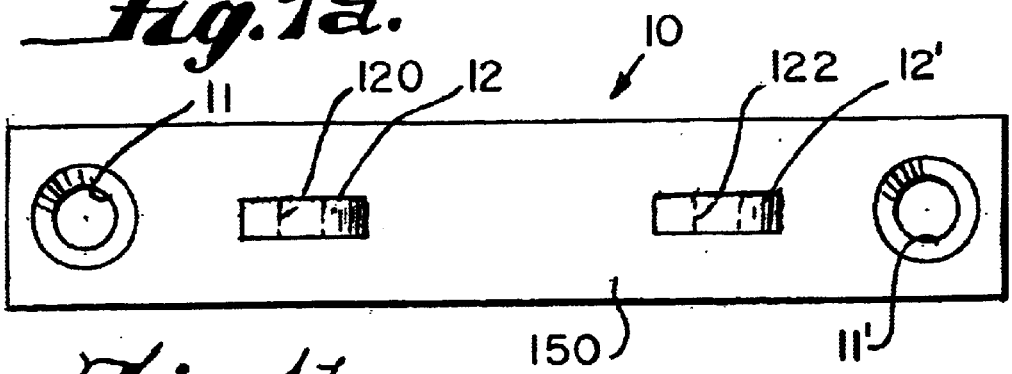
FIG. 1*a* is a bottom view in partial phantom of the base member of a plunger assembly as the assembly would be mounted on the top plate of a blanking press, according to an embodiment of the present invention.

The present invention overcomes the problems of the prior art by providing a plunger assembly of simple construction having fewer components and smaller dimensions than conventional presser assemblies. The plunger assembly of the present invention therefore tends to advantageously be less costly to manufacture than a conventional presser assembly, easier for the manufacturer to assemble and can be shipped pre-assembled. The plunger assembly according to the present invention can be easily and efficiently mounted to a backer board of a blanking device. In addition, the size and construction of the plunger assembly of the present invention enable it to be used in small or otherwise inaccessible locations, where larger, conventional presser assemblies cannot fit.

The present invention is also directed to a system including a blanking sheet presser assembly and at least one plunger assembly according to the present invention, wherein the presser assembly and the plunger assembly are mounted on a common surface. The presser assembly can be a folding presser assembly as described in U.S. patent application Ser. No. 10/054,127 to Myers et al., filed Oct. 22, 2001 and entitled "Folding Presser Assembly" (Atty. Docket No. 3660-015-01). The aforementioned patent application and all other patents and publications mentioned therein are hereby incorporated herein in their entireties by reference.

The present invention is further directed to a kit containing at least one folding presser assembly and at least one plunger assembly, wherein the folding presser assembly and the plunger assembly are packaged together.

According to an embodiment of the present invention, the invention provides a plunger assembly that includes at least one pair of connecting legs between a base member and a pivoting gripper member. The pair of connecting legs establishes and maintains a distance between the base member and the pivoting gripper member. The pair is advantageously pivotable with respect to at least one of the base member and the pivoting gripper member for allowing the plunger assembly to be folded, thereby reducing the distance between the base member and the pivoting gripper member. Connecting legs connected to the base member are herein referred to as base legs, and connecting legs connected to the pivoting gripper member are herein referred to as gripper legs. Each pair of connecting legs are also adapted to pivot at the joint between the two legs. The joint is preferably provided with a biasing device or torsion means to bias the legs in an extended position maximizing the distance between the base member and the pivoting gripper member.

The pivoting gripper member is also referred to herein as a plunger member, and can be provided with a pad or cushion attached thereto that makes contact with a blank to be gripped or held in a blanking press. Folding the plunger assembly involves pivoting the pair of connecting legs with respect to at least one of the base member and the pivoting gripper member such that the distance between the base member and the pivoting gripper member is decreased. The ability to decrease and increase the distance between the base member and the pivoting gripper member, as is recognizable to those skilled in the art, advantageously allows an expedient gripping, blanking, and knock-out operation to take place. In a preferred embodiment, the legs can be compressed or extended independent of each other.

In the present description, when an element is said to be "connected" to another element, those elements may be connected to one another either directly or indirectly, that is, with one or more elements interposed therebetween.

In the drawing Figures, FIG. 1*a* is a bottom view in partial phantom of a base member 10 of a plunger assembly according to a preferred embodiment of the present invention. Exemplary dimensions of the base support member are a length of 2.875 inches, a width of 0.5 inch, and a thickness of 0.094 inch. The base member 10 includes first and second mounting holes 11, 11', preferably located near respective ends of the base support member 10 as shown. Mounting screws can be used through the mounting holes 11, 11' to mount the base member 10 and a respective plunger assembly to a platen or counterplate of a blanking press. FIG. 1*a* also shows the exemplary locations of two base pivot flanges or nodes 12, 12', that are located between the mounting holes 11, 11', but projecting away from the top surface of the base member 10, as shown also in FIG. 1*b*.

Figure 1B:
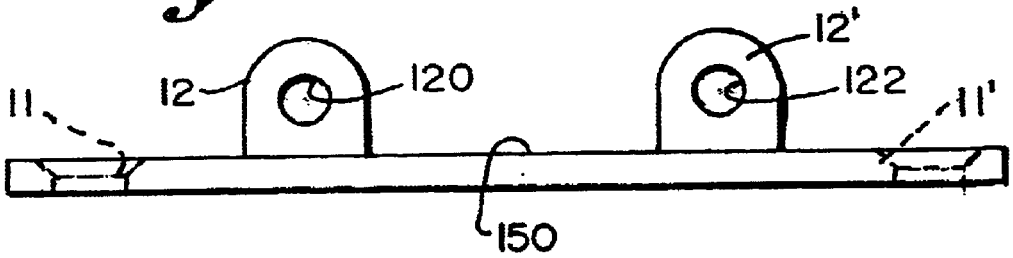
FIG. 1*b* is a side view in partial phantom of the base member shown in FIG. 1*a;*

FIG. 1*b* is a side view in partial phantom of the base support member showing the mounting holes 11, 11' and the upwardly projecting base pivot flanges 12, 12'. In an exemplary embodiment, each base pivot flange 12, 12' projects upwardly 0.327 inches from the top surface of the base member 10. Each pivot flange 12, 12' is equipped with an opening 120, 122 that can house an axle, screw, or other connecting pin or pivot device 13 to which can be attached a base leg 140/142 (not shown). The pivot device can be a projection from both faces of each pivot flange 12, 12' onto which is attached or snapped a pivotable base leg 140/142 (not shown) whereby a pivoting action between the base leg 140/142 and the pivot device.

Figure 2A:
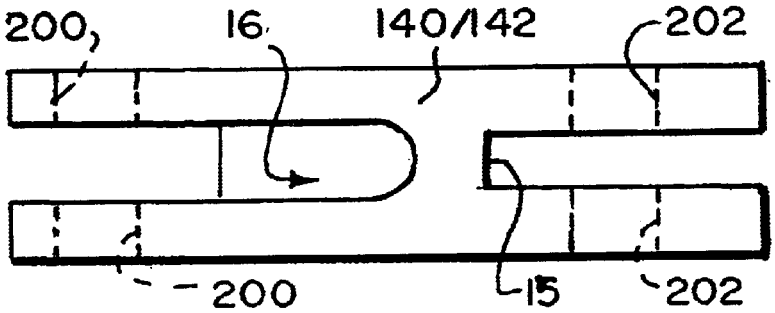
FIG. 2*a* is a bottom view in partial phantom of a base leg of a plunger assembly according to an embodiment of the present invention, that can be used in conjunction with the base member shown in FIGS. 1*a* and 1*b;*
Figure 5:
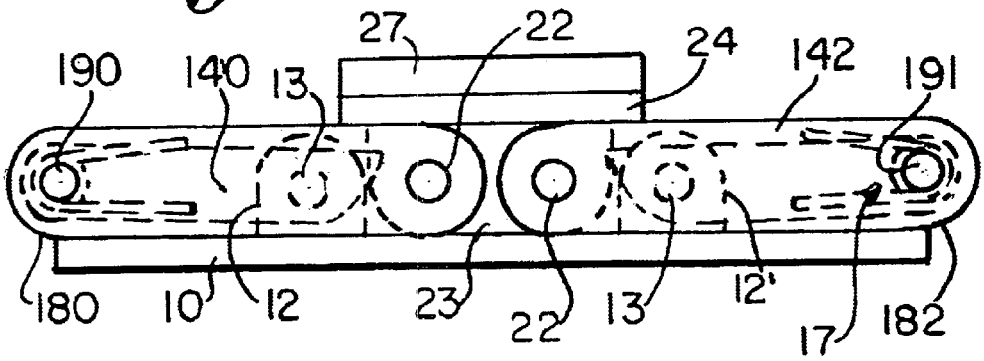
FIG. 5 is a side view in partial phantom of a plunger assembly according to an embodiment of the present invention, in a fully compressed position.

FIG. 2*a* is a bottom view in partial phantom of a base leg 140/142, which has a lower recess 15 adapted to straddle the pivot flange 12, 12' and pivotably attach to the base member 10 with a pin or other pivot device. The exemplary dimensions of the base leg 140/142 are a length of 1.159 inches, with a width of 0.312 inch, and 0.25 inch. The base leg 140/142 also has an inner recess 16 adapted to receive, straddle, and stabilize an arm of a torsion spring 17 (not shown in FIG. 2*a*). An exemplary spring 17 is depicted in FIG. 5 in a compressed position and is mounted on or within the base leg 140/142 bridging the pivotable joint formed between the base leg 140/142 and the gripper leg 180/182. The torsion spring 17 can comprise a wound metal wire or other spring mechanism known to those skilled in the art. Preferably, the torsion spring 17 is movably mounted on an axle 190 forming a pivot joint between the gripper leg 180/182 and the base leg 140/142. Preferably, the torsion spring 17 biases the gripper leg 180/182 and the base leg 140/142 into an open or extended position, whereby the distance between the base member 10 and the pivoting gripper member 24 is maximized.

Figure 2B:
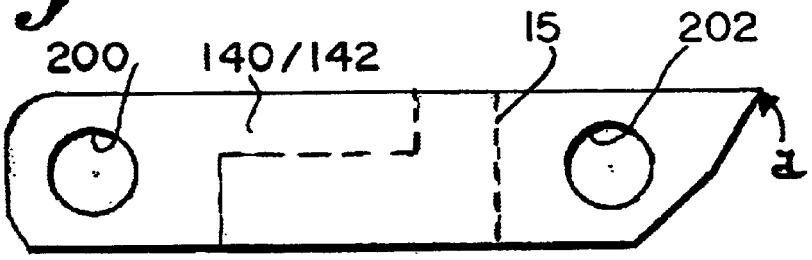
FIG. 2*b* is a side view of the base leg shown in FIG. 2*a;*

FIG. 2*b* is a side view of the base leg 140/142 shown in FIG. 2*a*. The base leg 140/142 has first and second connecting holes 200, 202, located near respective ends of the base leg 140/142. Connecting hole 202 of the base leg 140/142 pivotably attaches to the pivot device associated with the opening 120, 122 in the pivot flange 12, 12' of the base member 10. The pivotal attachment forms the base leg pivot joint described above. Connecting hole 200 receives an axle 190, 191 (FIGS. 5–7), forming a pivot joint between the gripper leg 180/182 and the base leg 140/142. The apex "a" of base leg 140/142 forms a brake or stop, wherein the biasing of the base leg 140/142 in an extended manner is stopped by the contact of apex "a" with the surface 150 of base member 10. Thus, the size, shape and angle of apex "a" can be varied to achieve the desired maximum extension of, and angle between, the pivotable connecting base leg and gripper leg.

Figure 3A:
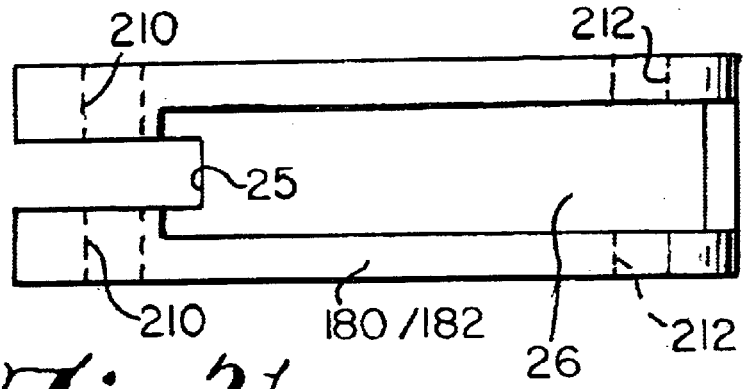
FIG. 3*a* is a top view in partial phantom of a gripper leg of a plunger assembly according to an embodiment of the present invention, that can be used in conjunction with the base member shown in FIGS. 1*a* and 1*b* and the base leg shown in FIGS. 2*a* and 2*b;*

FIG. 3*a* is a top view in partial phantom of a gripper leg 180/182 which having a first hole 210 and a second hole 212, located near respective ends of the gripper leg 180/182. The second hole 212 receives the axle 190. The first hole 210 pivotably receives a pivot pin 22 that projects laterally from the face of a downwardly projecting flange or ridge 23 (FIGS. 4*a*, 4*b*) located on the underside of the pivoting gripper member 24. The gripper leg 180/182 has a recess 25 adapted to receive and straddle the downwardly projecting flange 23 of the pivoting gripper member 24. The gripper leg 180/182 also has a recess 26 adapted to receive and straddle the entire base leg 140/142 when the plunger assembly is compressed into a completely or partially folded position. The recess 26 of the gripper leg 180/182 also is adapted to receive an arm of the torsion spring 17. In an exemplary embodiment, the gripper leg 180/182 is 1.604 inches long, 0.375 inch wide, and 0.5 inch thick. The lower end of gripper leg 180/182 can overlap the upper end of the base leg 140/142, and through the overlapped region the axle 19 passes to thereby form the pivot joint between the gripper leg 180/182 and the base leg 140/142.

Figure 3B:
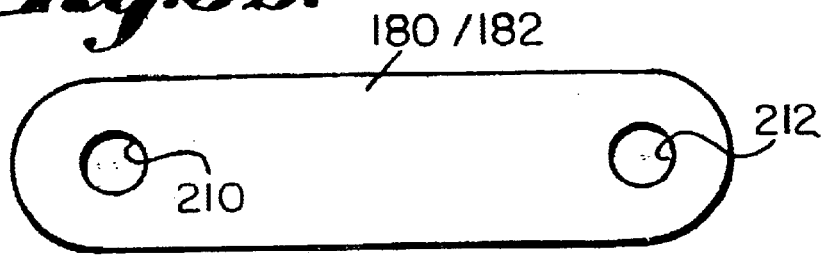
FIG. 3*b* is a side view of the gripper leg shown in FIG. 3*a;*

FIG. 3*b* is a side view of the gripper leg 18. In a preferred embodiment, the first hole 210 and the second hole 212 are located approximately 1.188 inches apart on a gripper leg 1.604 inches long.

Figure 4A:
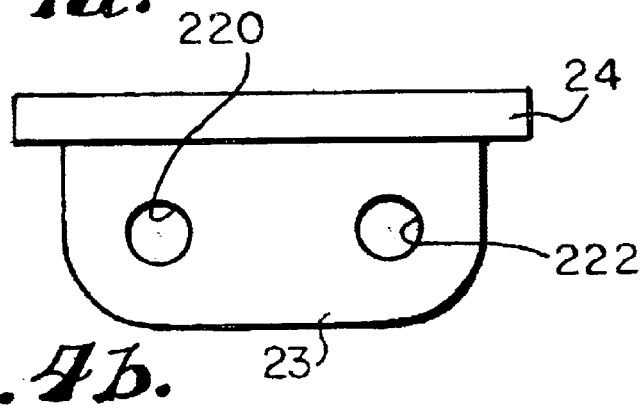
FIG. 4*a* is a side view of a pivoting gripper member of a plunger assembly according to an embodiment of the present invention, that can be used in conjunction with the base member, base leg, and gripper leg shown in FIGS. 1*a*–3*b;*

FIG. 4*a* is a side view of a pivoting gripper member 24, which, in an exemplary embodiment, is about 1 inch long, about 0.5 inch wide, and about 0.094 inch thick at its base. The pivoting gripper member 24 has a downwardly projecting flange or ridge 23 which, in a preferred embodiment, is straddled by the recess 25 of each gripper leg 180/182. The downwardly projecting flange or ridge 23 has pivot holes 220, 222, which can be replaced with or filled by laterally projecting pivoting means (not shown) extending from each side of the flange 23. Whether projections or pins are used, each is adapted to pivotably engage hole 210 in gripper leg 180/182, thereby forming a pivotable joint between the gripper leg 180/182 and the downwardly projecting flange 23 of the pivoting gripper member 24. The pivoting gripper member 24 can also have on its upper surface a pad or cushion 27 to improve the frictional engagement of the plunger assembly with the cut or uncut blank sheets.

Figure 4B:
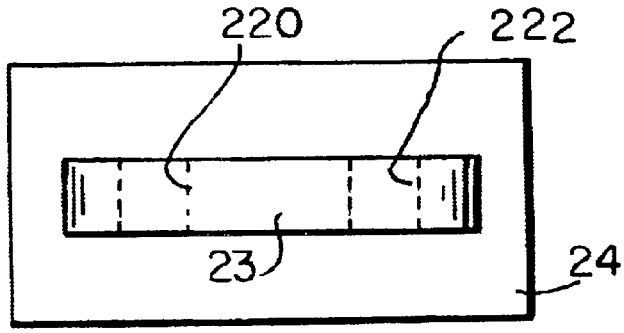
FIG. 4*b* is a top view of the pivoting gripper member shown in FIG. 4*a;*

FIG. 4*b* is a top view of the pivoting gripper member 24 and illustrates an exemplary embodiment of the approximate location of the holes 220, 222.

FIG. 5 is a side view in a partial phantom of an embodiment of the present invention in a fully compressed or fully folded position, wherein the distance between the pivoting gripper member 24 and the base member 10 has been minimized by application of a compressing force against the bias of the torsion springs 17. In an exemplary embodiment, the fully compressed plunger assembly of the present invention has a height of about 0.688 inch and a length of about 3.219 inches.

Figure 6:
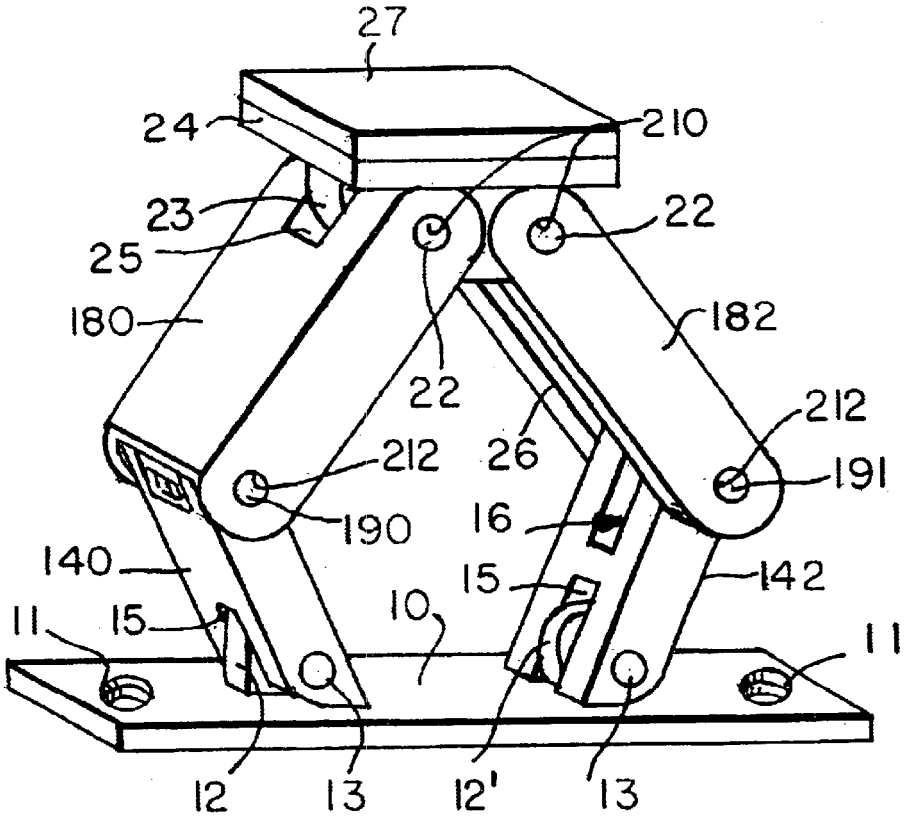
FIG. 6 is a perspective view of the plunger assembly shown in FIG. 5, in an expanded position.

FIG. 6 is a perspective view of the plunger assembly shown in FIG. 5 in an expanded or fully unfolded position. As can be seen in FIG. 6, the top pivoting gripper member 24 can pivot on laterally projecting pivoting pins or projections through or integral with holes 220, 222 (not shown) in the pivoting gripper member 24 at the pivot joint formed at the upper end of the gripper legs 180/182. This pivoting can occur with or without any compression of the respective torsion spring 17, or movement of the respective base leg 14.

Figure 7:
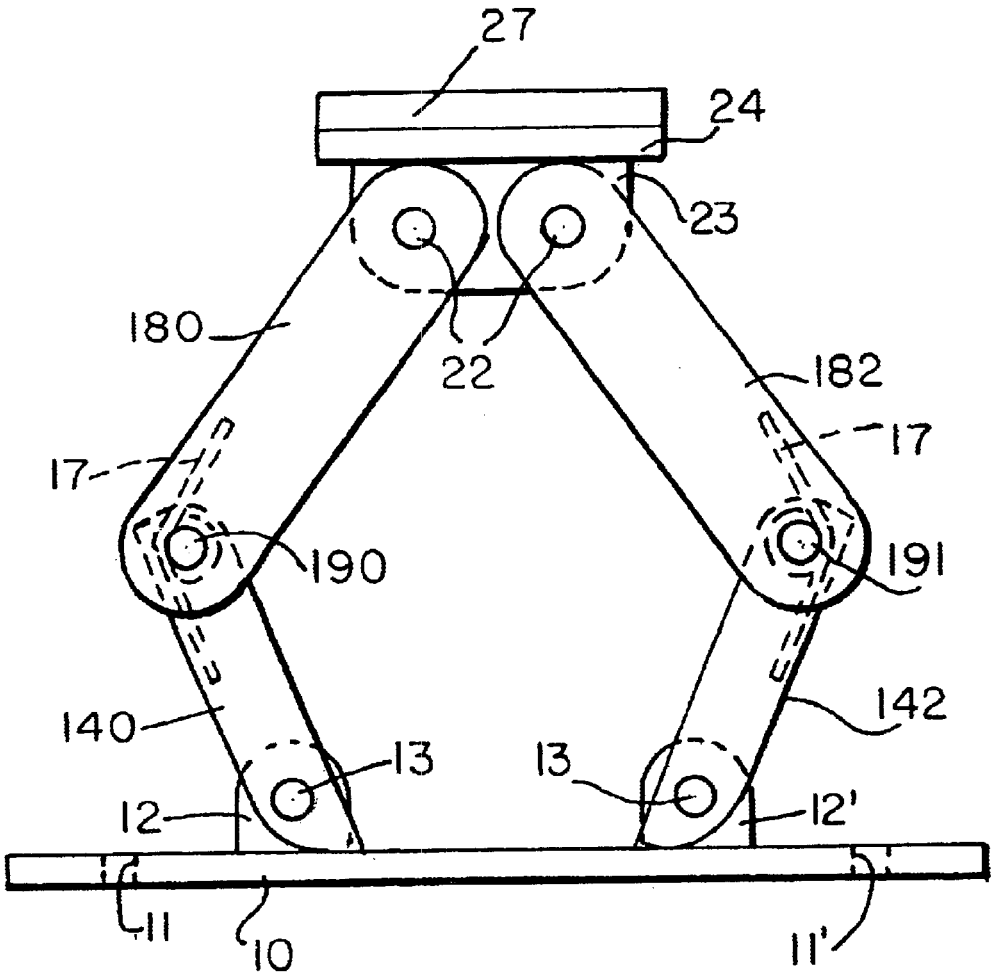
FIG. 7 is a side view in partial phantom of the plunger assembly shown in FIG. 6.
Figure 8:
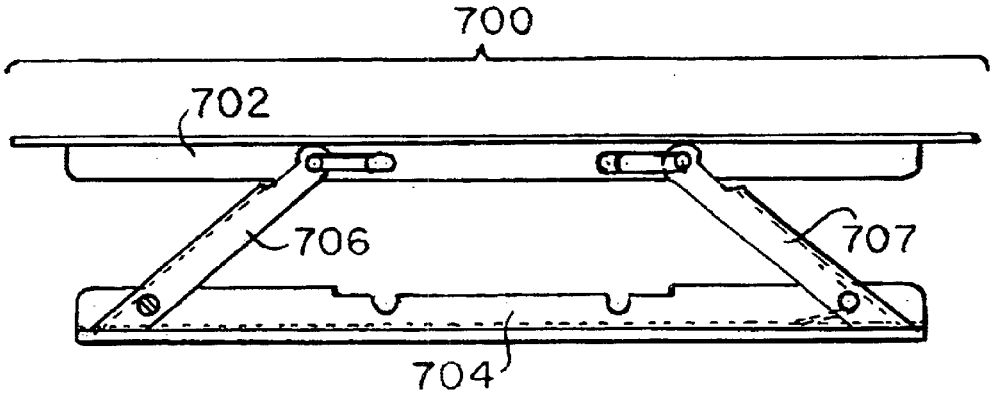
FIG. 8 is a side view of a folding presser assembly included in a kit according to an embodiment of the present invention.
Figure 9:
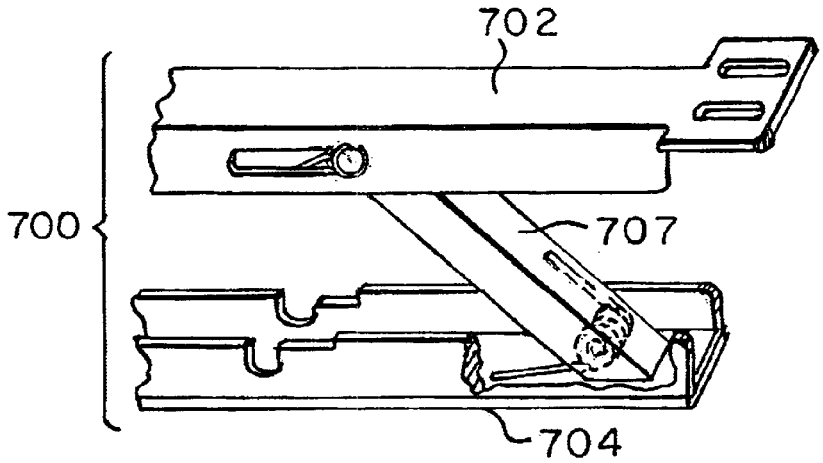
FIG. 9 is a close-up perspective view of an end portion of the folding presser assembly shown in FIG. 8.

FIG. 7 is a side view in partial phantom of the plunger assembly shown in FIG. 6. In an exemplary embodiment as shown, the angle between the upper and lower legs when biased at full extension is about 122°, the angle between the base member 10 and the base leg 140/142 is about 67°, and the angle between the gripper leg 180/182 and the pivoting gripper member 24 is about 55°.

It should be noted that the dimensions recited above for exemplary embodiments are not limitations, and assemblies with increases and decreases in size are fully contemplated within the scope of the present invention. It is to also be understood that other preferred embodiments of the plunger assembly of the present invention include those embodiments where at least two or more of the respective dimensions mentioned above, although not equal or approximately equal to the stated dimensions above, exhibit approximately the same proportions as corresponding ones of the stated dimensions above.

In addition, the gripper legs 180/182, the base legs 140/142, the base member 10, and the pivoting gripper member 24 are depicted as solid pieces, but the present invention also includes variations wherein one or more of the aforementioned parts is or are hollow, grooved, perforated or otherwise not fully solid.

The embodiment depicted in the figures has the gripper legs that overlap the base legs at the pivotable joint between the gripper legs and the base legs. It is also included in the present invention to have the base legs overlap the gripper legs instead at the pivotable joints between the gripper legs and the base legs.

It is preferred, but not required, herein that the component parts of the plunger assembly of the present invention are made of plastic materials or metal materials, preferably lightweight, inexpensive, easily machined, stamped, and/or extruded, metals. Examples of such preferred plastic materials include, but are not limited to, polyester, polyamide, polyimide, epoxy, acrylics, polycarbonates, and the like. Examples of preferred metals include, but are not limited to, aluminum, stainless steel, copper, titanium, nickel, iron, chromium, and the like.

In operation, as is readily recognizable to those skilled in the art, the base member 10 may be pushed toward the pivoting gripper member 24 for pivoting the connecting legs 140/142 and 180/182 with respect to at least one of the base member 10 and the pivoting gripper 24. The pushing reduces the angle between the gripper leg 180/182 and the base leg 140/142, as well as the angle between the base leg 140/142 and the base member 10, thereby folding the plunger assembly and reducing the distance between the pivoting gripper member 24 and the base member 10. In a similar but alternative manner, the pivoting gripper member 24 can be pushed toward the base member 10. For unfolding the plunger assembly, the method according to the present invention includes the step of pivoting the connecting legs 140/142 and 180/182 with respect to at least one of the base member 10 and the pivoting gripper member 24 for increasing the aforementioned angles defined therebetween, thereby unfolding the plunger assembly and increasing the distance between the pivoting gripper member 24 and the base member 10. For achieving a fully folded, compressed, or nested state of the plunger assembly, the method according to the present invention includes the step of pivoting the connecting legs fully to achieve a fully folded, compressed, or nested state of the plunger assembly. When completely folded, the base support member, the connecting legs, and the plunger member are substantially parallel with respect to one another, and preferably such that the downwardly projecting flange on the underside of the pivoting gripper member 24 rests upon the base member 10.

A particular advantage of the plunger assembly of the present invention is its ability to pivot in two directions, but its rigidity and resistance to movement in a third direction. The plunger device can compress in the depth, or "z"

direction, can pivot in the "y" direction, but will not move laterally in the "x" direction. Such lateral, sideways, or "x" direction, movement relative to the length of the plunger assembly device can be undesirable. Preventing lateral, "x" direction, movement improves the ability to maintain registration of the blanking sheet.

The small and simple plunger assembly of the present invention can fit into many locations that are inaccessible to larger, conventional presser assemblies.

The present invention further includes within its scope a plunger assembly for supporting blanking scrap during a blanking operation, wherein the plunger assembly includes: connecting means for connecting a gripping means to a support means and being adapted to pivot with respect to the gripping means through a predetermined pivot angle range for changing a distance between the gripping means and the support means. The connecting means can thereby selectively effect a folding and unfolding of the plunger assembly during a blanking operation. The connecting means can be those means substantially shown and described above, for example, with reference to the connecting legs shown in FIGS. 1*a* through 7. The gripping means can be those means substantially shown and described above, for example, with reference to the pivoting gripper member shown and described in connection with FIGS. 1*a* through 7. The support means can be those means substantially shown and described above, for example, with reference to the base member shown and described in connection with FIGS. 1*a* through 7.

In another embodiment, the plunger assembly further comprises a torsion means such as a spring, accommodated in recesses in each pair of connecting legs. The plunger assembly of the present invention can include one or more pairs of connecting legs such as a first leg and a second leg. The legs respectively include a first recess and a second recess. The first leg can be a base leg as described above, including a spring arm recess. The second leg can be a gripper leg, as described above, including a trough for receiving the gripper leg and against the bottom of which the opposite spring arm can rest. The spring can be a torsion spring each including a distal arm and a proximal arm, with the distal arm resting in the recess of the gripper leg and the proximal arm resting against the bottom of the trough of the base leg.

As can be appreciated from the figures, the plunger assembly device is configured for effecting a folding or compressing of the plunger assembly device such that, in a fully folded state of the plunger assembly, the pivoting gripping member, the connecting legs, and the base member are substantially parallel to each other. Advantageously, the invention provides a plunger assembly that is easy to install on blanker boards, for example, male blanker boards, and that, by virtue of its simple construction, is easily manufactured, generally less costly to manufacture than presser assemblies of the prior art, and can be removed from blanker boards with ease to be changed or reused. Furthermore, the plunger assembly according to the present invention maintains the advantages of prior art presser assemblies, such as the ability to adjust to unequal pressure on the assembly while substantially eliminating the possibility that the assembly will jam, as happens with presser assemblies of the prior art.

In another embodiment, the present invention also provides a kit for forming a plunger assembly for gripping a blanking sheet during a blanking operation. The kit, according to the present invention, includes packaged together at least one base member, a pivoting gripper member, adapted to be connected to the base member; and a pair of connecting legs adapted to connect the base member to the pivoting gripper member and adapted to pivot with respect to at least one of the base member and the pivoting gripper member. The connecting legs can preferably pivot in an assembled state of the plunger assembly through a predetermined pivot angle for changing a distance between the base member and the pivoting gripper member. The kit preferably contains a torsion means or spring in the plunger assembly to bias the connecting legs into a position to maximize the distance between the base member and the pivoting gripper member.

The kit of the present invention can further include, packaged together, at least one folding presser assembly 700 for supporting blanking scrap during a blanking operation. The presser assembly preferably is of the type including: a support rail 702; a presser rail 704 connected to the support rail 702; and a connecting rail 706/707 connecting the presser rail 704 to the support rail 702. The connecting rail 706/707 is adapted to pivot with respect to at least one of the support rail 702 and the presser rail 704 through a predetermined pivot angle range a for changing the distance between the support rail and the presser rail. In so doing, the presser assembly is able to selectively fold and unfold during the blanking operation. A well-suited folding presser assembly that can be used is the folding presser assembly described in U.S. patent application Ser. No. 10/054,127 to Myers et al., filed Oct. 22, 2001 and entitled "Folding Presser Assembly", which is incorporated herein in its entirety by reference.

In another embodiment of the present invention, the invention includes a system for gripping a blanking sheet. The system includes at least one folding presser assembly, and at least one plunger assembly. The folding presser assembly includes at least one folding presser assembly as described above. The plunger assembly can be any of the plunger assemblies described above. In a preferred embodiment of the system, the presser assembly and the plunger assembly are each attached, fixed, connected, or mounted in the same or similar manner, on, or to, a common surface, for example, a blanking press platen or counter plate. In a more preferred embodiment, both the folding presser assembly and the plunger assembly are attached to a platen or die press plate.

It will be apparent to those skilled in the art that the disclosed invention may be modified in numerous ways and may assume many embodiments other than the preferred forms specifically set out and described above. Accordingly, it is intended that the appended claims cover all modifications of the present invention that fall within the true spirit and scope of the present invention.

What is claimed is:

1. A plunger assembly for gripping blanking material during a blanking operation, said plunger assembly comprising:

a base member;

a pivoting gripper member;

a biasing device; and at least one pair of connecting legs, said at least one pair of connecting legs including a gripper leg and a base leg pivotally connected to one another, said gripper leg also being pivotably connected to said pivoting gripper member, said base leg also being pivotably connected to said base member, and said pivoting gripper member being pivotable with respect to said gripper leg through a predetermined pivot angle range, said gripped leg and said base leg being pivotable with respect to one another for changing a distance between the pivoting gripper member and the base member, thereby selectively effecting a folding and unfolding of the plunger assembly during a blanking operation, wherein the biasing device biases the pivoting gripper member away from the base member.

2. The plunger assembly according to claim 1, wherein said at least one pair of connecting legs comprises two pairs of connecting legs that are mirror images of each other.

3. The plunger assembly according to claim 1, wherein the biasing device is disposed for biasing the base leg away from the gripper leg and into an unfolded position.

4. The plunger assembly according to claim 1, wherein the biasing device comprises a torsion spring.

5. The plunger assembly according to claim 2, further comprising a biasing device for each pair of connecting legs, each biasing device comprising a torsion spring disposed at a pivot joint between the base leg and gripper leg of each pair of connecting legs.

6. The plunger assembly according to claim 1, wherein the biasing device comprises a torsion spring having a first spring arm that bears against the base leg, and a second spring arm that bears against the gripper leg.

7. The plunger assembly according to claim 6, further including a pivot pin that passes through the base leg, the gripper leg, and the torsion spring, said base leg and said gripper leg pivoting with respect to one another on said pivot pin.

8. The plunger assembly according to claim 2, wherein the pivoting gripper member includes a downwardly projecting flange thereon, and the gripper leg of each pair of connecting legs is pivotally connected to the projecting flange.

9. The plunger assembly according to claim 2, wherein the gripper leg of each pair of connecting legs includes a trough, and the respective base leg of each pair of connecting legs is received in said trough in a fully folded state of the plunger assembly.

10. The plunger assembly according to claim 2, wherein the gripper leg of each pair of connecting legs includes:

a slot at a first end thereof, and the pivoting gripper member includes a downwardly projecting flange and wherein a respective gripper leg is pivotally connected to the flange such that the flange is received within said slot of said respective gripper leg.

11. The plunger assembly according to claim 2, wherein:

the base leg of each pair of connecting legs includes a slot at an end thereof; and the base member includes a first projecting flange and a second projecting flange, wherein the base legs of the two pairs of connecting legs are respectively pivotally connected to the first projecting flange and the second projecting flange such that the first projecting flange and the second projecting flange are respectfully received within the corresponding slots of the base legs.

12. The plunger assembly according to claim 2, wherein pivot pins are provided at connections between the pivoting gripper member and the gripper legs, between the gripper legs and the respective base legs, and between the base legs and the base member.

13. The plunger assembly according to claim 1, wherein the at least one pair of connecting legs is configured for effecting a folding of the plunger assembly such that, in a fully folded state of the plunger assembly, the base member, the base leg, the gripper leg, and the pivoting gripper member are substantially parallel to one another.

14. A kit including components for forming at least one plunger assembly for gripping blanking material during a blanking operation, said kit comprising at least one base member; a pivoting gripper member adapted to be connected to the base member; at least one pair of pivotable connecting legs adapted to connect the base member to the pivoting gripper member, said pair of connecting legs adapted to pivot with respect to at least one of the base member and the pivoting gripper member in an assembled state of the plunger assembly through a predetermined pivot angle for changing a distance between the base member and the pivoting gripper member; and a biasing device to bias the pivotable connecting legs into a position that maximizes the distance between the base member and the pivoting gripper member.

15. The kit of claim 14, further comprising components for forming at least one folding presser assembly for supporting blanking scrap during a blanking operation, said components for forming the at least one presser assembly comprising:

a support rail;

a presser rail connected to the support rail; and a connecting rail connecting the presser rail to the support rail and being adapted to pivot with respect to at least one of the support rail and the presser rail through a predetermined pivot angle range for changing the distance between the support rail and the presser rail thereby selectively effecting a folding and unfolding of the presser assembly during the blanking operation.

16. A system for gripping a blanking sheet, said system including at least one folding presser assembly and at least one plunger assembly, said folding presser assembly comprising: a support rail, a presser rail connected to the support rail; and a connecting rail connecting the presser rail to the support rail and being adapted to pivot with respect to at least one of the support rail and the presser rail through a predetermined pivot angle range for changing the distance between the support rail and the presser rail thereby selectively effecting a folding and unfolding of the presser assembly during the blanking operation, and said plunger assembly comprising: a base member; a pivoting gripper member; and at least one pair of connecting legs connecting the base member to the pivoting gripper member, said pair of connecting legs including a gripper leg and a base leg pivotally connected to one another, said gripper leg also being pivotally connected to the pivoting gripper member so as to be pivotable through a predetermined pivot angle range and said base leg being pivotally connected to the base member so as to be pivotable through a predetermined pivot angle range for changing a distance between the pivoting gripper member and the base member to thereby selectively effect a folding and unfolding of the plunger assembly during a blanking operation.

17. The system of claim 16, further comprising a blanking press platen, and wherein said presser assembly and said plunger assembly are attached to the blanking press platen.

* * * * *